US005577623A

United States Patent [19]

Bustos

[11] Patent Number: 5,577,623

[45] Date of Patent: Nov. 26, 1996

[54] COMPOSITE GRAVITY FEED SHELF

[75] Inventor: Rafael T. Bustos, Alpharetta, Ga.

[73] Assignee: L&P Property Management Company, Chicago, Ill.

[21] Appl. No.: 343,222

[22] Filed: Nov. 22, 1994

Related U.S. Application Data

[63] Continuation-in-part of Ser. No. 234,234, Apr. 28, 1994, Pat. No. 5,490,600, which is a continuation-in-part of Ser. No. 16,783, Feb. 11, 1993, Pat. No. 5,333,746.

[51] Int. Cl.[6] ..... A47F 5/00

[52] U.S. Cl. ..... 211/187; 211/59.2; 211/153; 211/184; 108/180

[58] Field of Search ..... 211/187, 59.2, 211/153, 184, 186; 108/180, 181

[56] References Cited

U.S. PATENT DOCUMENTS

| | | | |
|---|---|---|---|
| 2,643,170 | 6/1953 | Vanderveld et al. . | |
| 3,120,199 | 2/1964 | Kolster et al. . | |
| 3,556,306 | 1/1971 | Shell | 211/187 X |
| 3,601,256 | 8/1971 | Bowers, Jr. et al. . | |
| 3,643,607 | 2/1972 | MacKenzie | 211/153 X |
| 4,063,518 | 12/1977 | Bustos . | |
| 4,078,664 | 3/1978 | McConnell | 211/187 X |
| 4,101,233 | 7/1978 | McConnell | 211/187 X |
| 4,108,085 | 8/1978 | Shepherd et al. . | |
| 4,128,177 | 12/1978 | Bustos | 211/59.2 |
| 4,344,367 | 8/1982 | Merl . | |
| 4,461,388 | 7/1984 | Bustos | 211/184 X |
| 4,519,508 | 5/1985 | Guillett et al. | 211/153 X |
| 4,756,430 | 7/1988 | Spamer et al. . | |
| 4,809,855 | 3/1989 | Bustos . | |
| 5,088,607 | 2/1992 | Risafi et al. . | |
| 5,199,584 | 4/1993 | Fowler et al. | 211/184 |
| 5,265,740 | 11/1993 | Hodsden et al. . | |
| 5,333,746 | 8/1994 | Bustos | 211/187 |

*Primary Examiner*—Robert W. Gibson, Jr.
*Attorney, Agent, or Firm*—Wood, Herron and Evans, P.L.L.

[57] ABSTRACT

The gravity feed shelf design can be supported in either the cantilever configuration or upon a warehouse-style rack and includes an upper slip surface layer. The shelf design includes dividers which can be selectively positioned on the upper slip surface layer of the shelf to provide for adjustable width channels to arrange the merchandise in a gravity feed configuration upon the shelf. The shelf design includes an open frame configuration which supports a plurality of inverted box-shaped channels coupled together to provide a stable, rigid surface to support the merchandise thereon. A slip surface layer is then positioned atop the channels and open frame for the gravity feed advance of the merchandise on the shelf.

41 Claims, 5 Drawing Sheets

COMPOSITE GRAVITY FEED SHELF

This is a continuation-in-part of application Ser. No. 08/234,234 filed Apr. 28, 1994, U.S. Pat. No. 5,490,600, which was a continuation-in-part of Ser. No. 16,783, filed Feb. 11, 1993, now U.S. Pat. No. 5,333,746 issued Aug. 2, 1994.

BACKGROUND OF THE INVENTION

This invention relates to a shelf for use on display racks. More particularly, this invention relates to an improved gravity feed shelf for use in combination with a variety of styles of display racks, The above identified patent and application, of which this is a continuation-in-part, are directed to a shelf design and display rack system which offer unobstructed continuous display of merchandise due to the elimination of the display rack front posts. The elimination of front posts avoids the need for the shelf width to match the walk-in cooler door width. The display rack system allows the retailer the opportunity of a more individualized allocation of products based on sales merchandising schemes by providing individually adjustable shelves which can be moved forward or back relative to the cooler door without the need for repositioning of the entire display rack. Furthermore, the shelves can be individually adjusted vertically to accommodate varying heights of merchandise, and the shelves can be positioned variably between a 1° back slope inclination up to an 8° forward slope inclination relative to a horizontal plane for a gravity feed system as required.

Even though the shelves of the display rack system are adjustable vertically, horizontally and angularly as described, the manner of arranging the merchandise on the individual shelves is not addressed in the above-identified patent. The above identified patent application discloses a gravity feed display system in which the shelves include dividers for partitioning the merchandise into columns. The spacing between the dividers, and therefore the width of the merchandise which can be placed therein, is adjustable so that the shelf space can be efficiently used and the store manager has greater flexibility in arranging merchandise and designing a gravity feed display. The adjustable dividers do not require complicated attachment mechanisms and are easy to remove and reattach to the shelf when re-configuring the merchandise display.

The gravity feed shelf design disclosed in the co-pending application, Ser. No. 08/234,234 includes a plastic shelf insert which is supported in an open, generally rectangular shelf frame. The shelf frame and plastic insert are suspended in a cantilever configuration for use in a gondola style display rack. However, the plastic insert and open frame construction has proven to be less than satisfactory in certain applications. One such application in which the plastic insert has proven to be unacceptable is with a warehouse style rack which supports relatively heavy merchandise in a gravity feed configuration. A warehouse style rack is one with front and rear posts and the shelves supported upon beams extending between adjacent front posts and adjacent rear posts. Warehouse style racks typically are capable of supporting much more weight and heavier merchandise than gondola style racks. Therefore, the shelves must be sturdy and capable of handling the weight. Efficient use of shelf space on gravity feed warehouse style racks is also desirable, and preferably such a shelf design could be adapted for either warehouse style racks or cantilever type racks.

SUMMARY OF THE INVENTION

It has been an objective of the present invention to provide a display rack with shelves which can be easily re-configured to permit efficient use of the space thereon that do not require fixed or complicated divider attachment mechanisms or structures.

A further objective has been to provide a more stable, rigid shelf design which can be used on a variety of types of display racks such as warehouse style racks and gondola racks.

A further objective has been to provide such a shelf for cantilevered support in a display rack which can be individually adjusted up and down vertically, back and forth horizontally, and at various shelf inclinations.

These objectives of the present invention are obtained by a display rack system which includes shelves having adjustable dividers attached thereto. The shelf in the display rack of this invention includes an open frame having front, back and side frame members. A plurality of channels are positioned into the open frame to form the shelf. The channels are coupled to each other and provide a rigid, durable shelf which can be used on either a gondola or warehouse style display rack. A gravity feed slip surface layer with a plurality of spaced, parallel ribs extending between the front and back edges of the shelf is placed atop the channels. These ribs perform the dual functions of providing a slip surface for the gravity feed advance of the merchandise toward the front edge of the shelf and an attachment mechanism for dividers extending upwardly from the shelf to partition the upper surface of the shelf into channels.

The dividers include an inverted Y-shaped base which can be positioned at a plurality of places across the top of the slip surface layer. The base engages adjacent ribs on the slip surface layer. Each divider has an upwardly bowed configuration and a notch at a front and a back end thereof. A tab on the front and back frame members is inserted into the respective notch on the divider to secure the divider to the shelf. The bowed configuration of the divider helps to securely retain the tabs within the respective notches. The dividers can be easily detached from the shelf and re-attached at different positions.

A pair of adjacent dividers form a channel which organizes the merchandise into a column for the orderly gravity feed advancement on the shelf. The width of the channel is adjustable by repositioning the dividers on the shelf and thereby offering the retailer greater flexibility in designing a merchandising scheme while efficiently utilizing available shelf space. Additionally, the shelf design of this invention can be cantilevered from a gondola rack just as in U.S. Pat. No. 5,333,446, and application Ser. No. 08/234,234, each of which are hereby incorporated by reference, or a warehouse style display rack in which both the front and back edges are supported on cross-beams.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
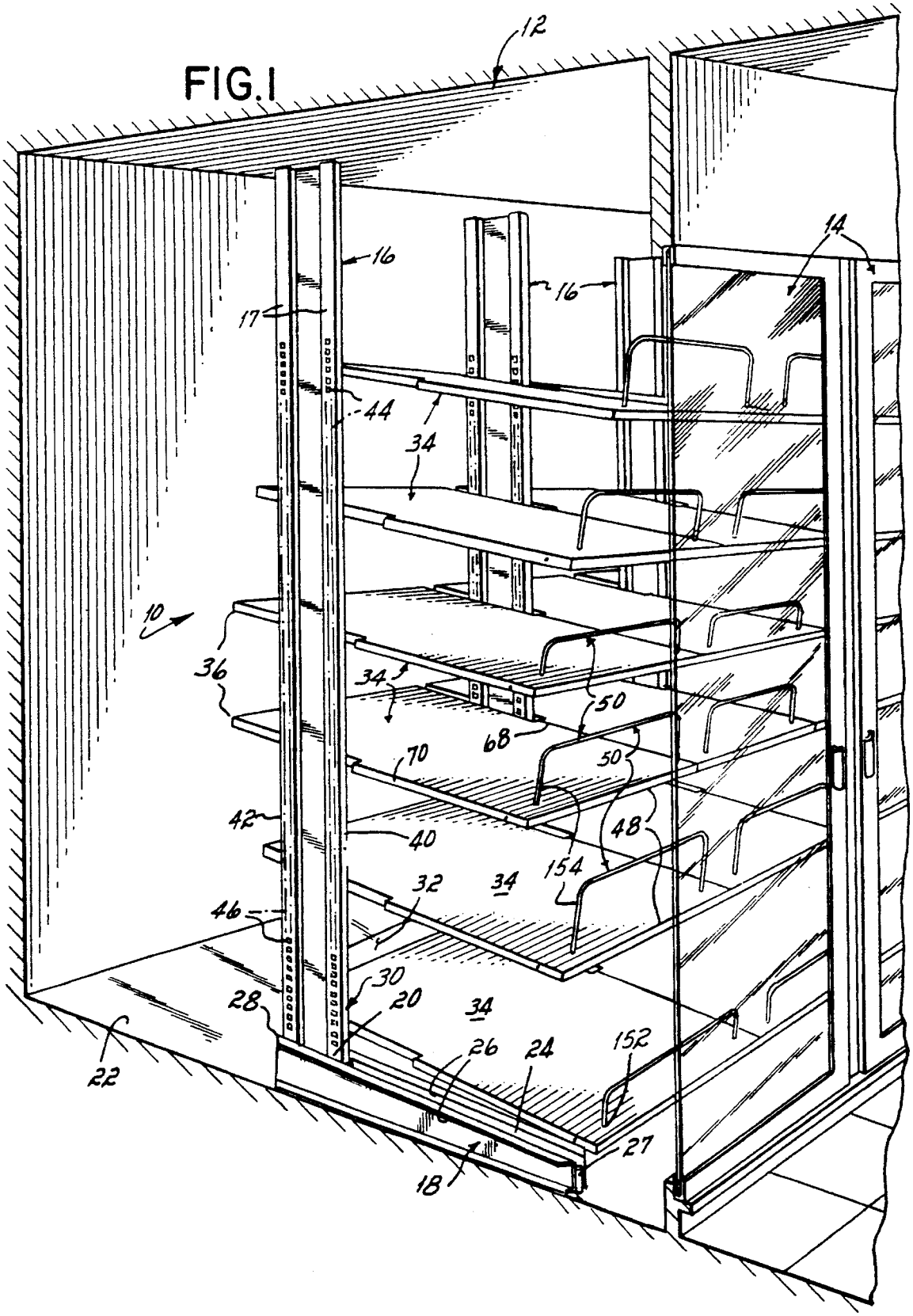
FIG. 1 is a perspective cross-section view of a walk-in cooler having a plurality of shelves in a gondola style display rack according to the present invention contained therein.

Referring to FIG. 1, a display rack system 10 of the present invention is shown within a walk-in refrigerated cooler 12 for which access to merchandise contained on the display rack 10 is available through cooler doors 14. The display rack 10 consists of generally vertical upright posts 16 which are supported by elongated bases or shoes 18 which are located at a lowermost end 20 of the post on a floor 22 of the walk-in cooler. Each shoe 18 has an upwardly open channel 24 formed by a pair of shoe side walls 26. The post 16 is secured between the shoe side walls 26 at the furthermost back end 28 of each shoe 18.

The post 16 and shoe 18 combination form a generally L-shaped frame section 30 of which a plurality of L-shaped frame sections are joined in a generally parallel configuration by a spacing panel 32.

A plurality of shelves 34 of a first embodiment are attached in a cantilever manner between each pair of adjacent upright posts 16 in the present invention. The shelves 34 are attached to the posts 16 such that they extend forward to the cooler doors 14 thereby allowing access by customers through the cooler doors to the merchandise contained thereon. In the display rack system 10 of the present invention full access is available to merchandise contained on the shelves in that there are no front posts to obstruct access to the merchandise. Furthermore, the shelves can be restocked at the appropriate times by accessing a rear edge 36 of the shelves 34 between the upright posts 16.

The posts 16 of the present invention include on each lateral side wall 17 thereof a pair of parallel slot columns 44, 46 of which one column of slots 44 is located near a forward edge 40 of the post and the other column of slots 46 is positioned near a rear edge 42 of each post. The forward column of slots 44 and rear column of slots 46 are each used to support the shelves 34 which may be repositioned vertically along the height of the post 16, within a horizontal plane forward or backward relative to the post 16, and angularly on an incline relative to a horizontal plane. The angular inclination of the shelves 34 provides for a gravity feed system which allows merchandise to be accessed by the customer at a front edge 48 of each shelf and restocked by a store employee from the rear edge 36 of each shelf. A bumper wire 50 as shown in FIG. 1 is provided at the front edge 48 of each shelf 34 to retain the merchandise contained thereon. The selective positioning of the shelves 34 and other features of the invention and described in U.S. Pat. No. 5,333,746.

The shelves 34 are attached to the post 16 by a shelf support bracket 66 on each lateral edge of the shelf. A shelf support bracket which would be suitable for attaching a right side 68 of the shelf to a post 16 is shown in FIG. 2; a similarly designed shelf support bracket (not shown) would be configured for attachment on a left side 70 of each shelf.

The gravity feed orientation for the shelf 34 in the display rack system 10 is desirable for restocking purposes in that once the forwardmost item on the shelf 34 is removed by the customer, as a result of the gravity feed inclination of the shelf, subsequent items would advance forward and be retained by the bumper wires 50 which are described later in this disclosure.

Figures 2, 3A:
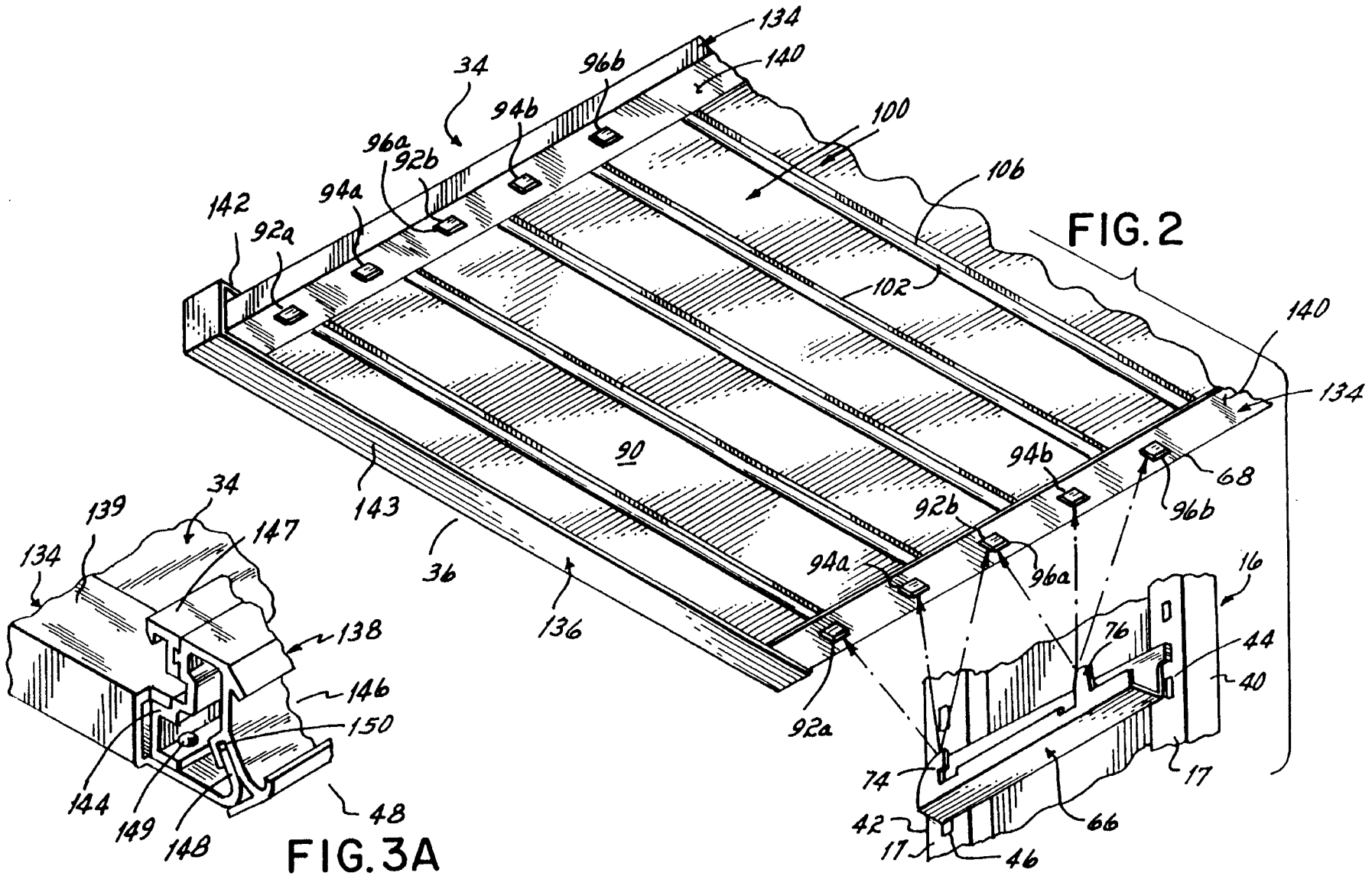
FIG. 2 is a perspective view from the underside of a first embodiment of a shelf which has holes arranged on each lateral edge thereof into which a shelf support bracket can be inserted for positioning the shelf forward or backward relative to the post of the display rack of FIG. 1 or adjusting the gravity feed inclination of the shelf.
FIG. 3A is an enlarged view of the side frame member joined to the front frame member of the shelf of FIG. 3.

As shown in FIG. 2, the shelf support bracket 66 engages a series of hole pairs 92*a–b*, 94*a–b*, 96*a–b*, in the bottom side 90 of each shelf along each lateral edge 68, 70. The stub 76 and shelf hook 74 are each inserted into a selected hole pair on the bottom side 90 of the shelf. The holes are arranged in three pairs 92, 94 and 96 as shown in FIG. 2. The center hole 92*b*, 96*a* is used as the forward hole 92*b* in pair 92, and the rear hole 96*a* in pair 96. The rearmost hole of each pair 92*a*, 94*a* and 96*a* would be a hook hole adapted to receive the shelf hook 74, and the forwardmost 92*b*, 94*b* and 96*b* of each pair would be a stub hole adapted to receive the stub 76 on the shelf support bracket 66.

Figure 3:
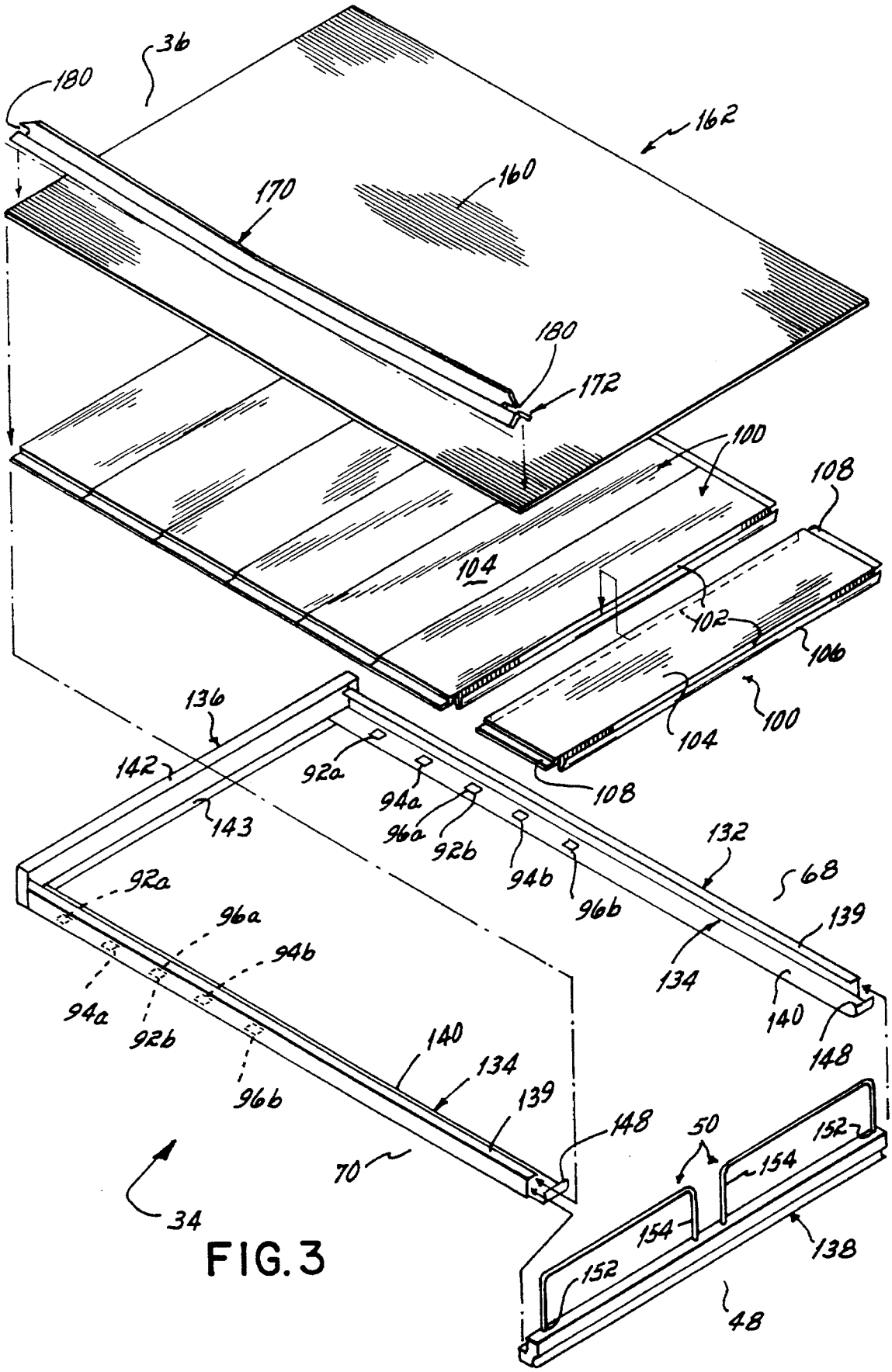
FIG. 3 is a disassembled perspective view from the top of the first embodiment of a gravity feed shelf of this invention.

The first preferred embodiment for the shelf 34 for use with the display rack system 10 of this invention is shown in FIGS. 3 through 9. This shelf design can be incorporated into the display rack system 10 for variable vertical, horizontal and angular adjustments as described in U.S. Pat. No. 5,333,746. The shelf 34 includes a generally rectangular open frame 132 consisting of a pair of spaced side frame members 134 connecting a back frame member 136 to a front frame member 138 (FIG. 3). Each side frame member 134, 134 consists of a generally U-shaped channel with a horizontal top leg 139 and a lower wider leg 140. The leg 140 of the shaped channel is fixedly secured at the back end to the lower leg of the back frame 136. The series of hole pairs 92*a–b*, 94*a–b*, 96*a–b* are provided in the wider leg 140 of the side frame member 134 for attachment to the shelf support bracket 66 as was described with reference to FIG. 2.

The back frame member 136 consists essentially of a box shaped channel having an open side directed toward the interior of the open front frame 132. The legs 140 of side frame members 134, 134 are inserted into the respective ends of an inwardly facing lower leg 143 of the back frame member 136 box channel as shown in FIG. 3. A tab 142 projecting inwardly toward the interior of the open frame 132 is also formed on the upper channel side wall of the back frame member 136.

Figures 4, 5, 6, 7, 8, 9:
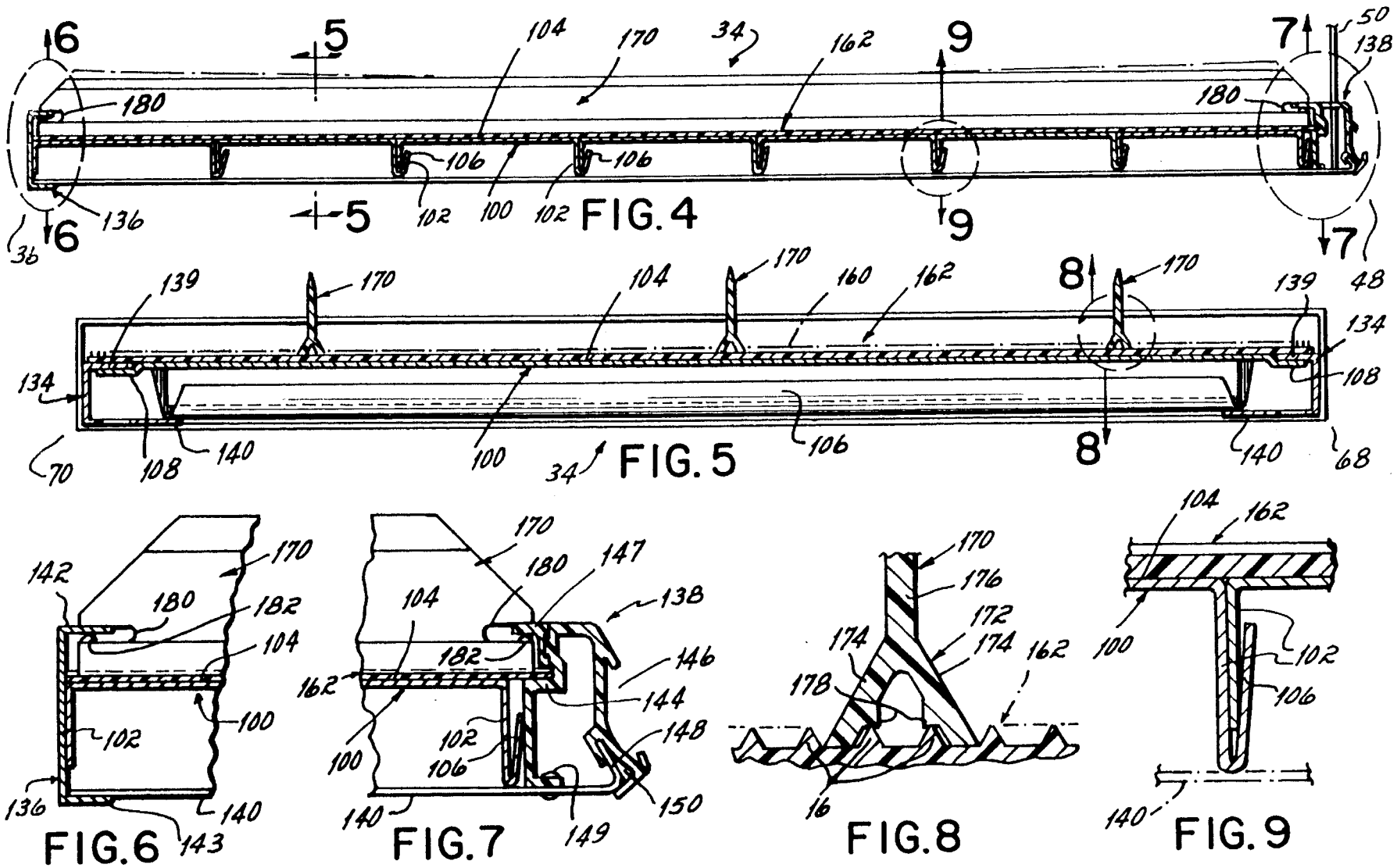
FIG. 4 is a longitudinal cross-sectional side view of the shelf of FIG. 3.
FIG. 5 is a transverse cross-sectional front view of the shelf as seen on lines 5—5 of FIG. 4.
FIG. 6 is an enlarged broken away side view of the encircled area 6—6 of FIG. 4 illustrating a divider secured to the back edge of the shelf.
FIG. 7 is an enlarged broken away side view of the encircled area 7—7 of FIG. 4 illustrating the front end of the divider secured to the front edge of the shelf.
FIG. 8 is an enlarged cross-sectional view of the encircled area 8—8 of FIG. 5 showing the attachment of the divider to the slip surface layer.
FIG. 9 is an enlarged cross-sectional view of the encircled area 9—9 of FIG. 4 illustrating adjacent channels of the shelf coupled together.

The front frame member 138 also consists essentially of a box-shaped channel having an inwardly facing transverse ledge 144 which extends to each end thereof. This ledge 144 accepts on each end the front ends of upper legs 139 of the side frame members 134, 134 as shown in FIG. 3A. The front frame member 138 also includes a tab 147 projecting toward the interior of the open frame 132 as shown in FIG. 7. Extending along the front edge of the front frame member 138 is an open upwardly angled channel 146 in which a price sticker or label (not shown) can be inserted relating to the merchandise supported on the shelf as is well known in the art. A front end of each side frame member's lower leg 140 includes an upstanding hook 148 which engages a slot 150 formed in the front frame member 138 proximate the back side of the price channel 146 as shown in FIGS. 3A and 7. The legs 140 are fixedly secured to the front frame member 138 by rivets 149, or the like.

A plurality of holes 152 are also included in the front frame member 138 in the uppermost side of the box-shaped channel. The holes 152 are positioned and adapted to receive legs 154 of a generally U-shaped bumper wire 50 as shown in FIG. 3. The legs 154 of the bumper wire 50 are inserted through the holes 152 in the front frame member 138 to attach the bumper wires 50 at the front edge of the shelf 34 and retain the merchandise thereon.

A plurality of generally inverted box-shaped channels 100 extend laterally across the open frame 132 of the shelf 34 in a presently preferred embodiment of this invention. Each inverted box-shaped channel 100 includes a pair of spaced side walls 102 projecting downwardly from a top wall 104 of the channel 100. The adjacent channels are coupled together to form a more rigid stable surface to support merchandise upon the shelf 34. An upwardly projecting hook 106 extends from a bottom edge of one of the sidewalls 102 of each channel 100. The sidewall 102 of an adjacent channel 100 is nested within the upwardly projecting hook 106 as shown in FIG. 9 to thereby couple the adjacent channels 100 together. It will be appreciated by one or ordinary skill in the art that although the channels 100 are shown in a box-shaped configuration extending laterally across the shelf 34 and are coupled together by the hook 106, other designs and configurations are possible within the scope of this invention.

As shown in FIGS. 3 and 5, a depressed ledge 108 is formed on opposing ends of each channel 100. The ledges 108 on each end of each channel 100 are inserted into the U-shaped side frame member 134 so that the ledge 108 is juxtapositioned to the horizontal top leg 139 as shown in FIG. 5. As a result, the horizontal top leg 139 of the side frame member 134 and the top wall 104 of the box-shaped channels 100 form a generally planar upper shelf surface. In addition, the bottom edge of the hook 106 on each channel 100 rests upon the upper surface of the lower leg 140 of each side frame member 134.

To assemble the components of the shelf design according to the presently preferred embodiment of the invention, the back 136 and side frame members 134 are assembled to form a U-shaped member. Depending on the size of the shelf, the appropriate member of box-shaped channels 100 are coupled together as shown in FIG. 3. The joined channels 100 are then slidably inserted into the opened mouth portion of the U-shaped frame assembly so that the ledges 108 underlie the top leg 139 of the side frame members 134 and the side walls 102 of the channels 100 are supported upon the lower leg 140 of the side frame members 134. Once the channels 100 are inserted into the side 134 and back frame members 136, the front frame member 138 is attached thereto and secured as by rivet 149 or other fastener as shown in FIG. 3A.

A slip surface layer 162 is then positioned atop the frame 132 and coupled channels 100 of the shelf 34 according to this invention. The slip surface layer 162 includes a plurality of generally parallel spaced ribs 160 projecting from an upper surface thereof as shown in FIG. 3. The slip surface layer 162 covers the top walls 104 of the coupled channels 100 and extends to cover the upper leg 139 of the side frame members 134 as shown in FIG. 5. Similarly, the slip surface layer 162 extends forwardly to the ledge 144 in the front frame member 138 as shown in FIG. 7 and rearwardly to the back frame member 136 as shown in FIG. 6.

The ribs 160 provide a slip surface layer 162 on the upper surface of the shelf 34 so that when the shelf 34 is in a gravity feed orientation, merchandise supported thereon advances by gravity atop the slip surface layer 162 toward the front edge 48 of the shelf 34. The merchandise is prevented from sliding off the front edge 48 of the shelf 34 by the bumper wires 50 inserted into the front frame member 138. Preferably, a silicone additive or coating is added to the slip surface layer 162 to reduce the friction between the merchandise and the shelf 130.

Dividers 170 are provided for attachment to the shelf 130 in a presently preferred embodiment. The dividers 170 project perpendicularly from the upper surface of the shelf 130 and extend longitudinally between the front and rear frame members 138, 136. The dividers 170 can be selectively attached and detached at a plurality of positions across the upper slip surface layer 162 of the shelf 34. The dividers 170 cooperate to form channels and separate the merchandise into columns for arrangement on the shelf 34. In the gravity feed configuration, the merchandise is arranged longitudinally on the shelf 34 in the channels between adjacent dividers 170. When the forwardmost item of merchandise is removed from the front edge of the shelf 34, the remaining items in the column behind the removed item advance by gravity atop the slip surface layer 162 toward the front edge of the shelf 34. As a result, the dividers 170 prevent the merchandise in an adjacent column from interfering with the gravity feed advance of the merchandise.

A bottom portion of each divider 170 has a generally inverted Y-shaped base 172 as shown generally in FIG. 5 and particularly in FIG. 8. The Y-shaped base 172 consists of a pair of legs 174, 174 which support a generally planar upper portion 176 of the divider 170. A bottom surface of each leg 174 of the base 172 is inserted between adjacent ribs 160 of the slip surface. Each leg 174 includes a lip projecting 178 inwardly toward the center of the base 172 to engage the upper surface of the rib 160 and stabilize the divider 170 on the shelf 34.

As shown in FIGS. 6 and 7, a notch 180 with an upwardly directed detent 182 formed on the lower side wall of the notch 180 is provided on the rear and front ends of each divider 170. Furthermore, as shown in FIG. 4, each divider 170 has a generally bowed configuration in which the front and rear ends are bowed upwardly relative to a middle portion of the divider 170. The dividers 170 are preferably extruded plastic and, as a result, are flexible and bendable. The tabs 142, 147 extending from the rear and front frame members 136, 138 are inserted into the notches 180, 180 at the rear and front ends, respectively, of the divider 170 as shown in FIGS. 6 and 7. Due to its bowed configuration, the divider 170 is securely retained on the shelf 34 with the bottom portion of the notch 180 and detent 182 being forced upwardly against the tab 142 or 147 in the frame member.

Furthermore, the bowed configuration assists the divider base legs 174 in maintaining a stable and secure position between the adjacent ribs 160.

The bowed configuration produces a friction fit of the divider 170 onto the upper slip surface 162 between adjacent ribs 160 and into engagement with the front and rear frame members 138, 136. Advantageously, the divider 170 can be easily removed or detached from a set position on the shelf 34 and reinstalled on the shelf 34 without damaging any of the components or requiring complicated and lengthy assembly procedures. As a result, the dividers 170 can be selectively positioned on the shelf 34 to form channels for merchandise of a variety of widths and efficiently utilize available shelf space.

Figure 11:
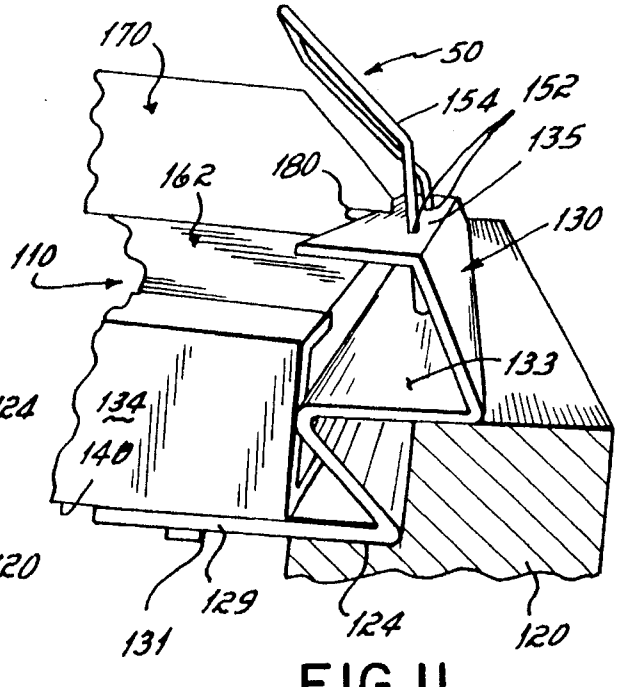
FIG. 11 is an enlarged view of the front frame member of the shelf as seen on lines 11—11 of FIG. 10.
Figure 10:
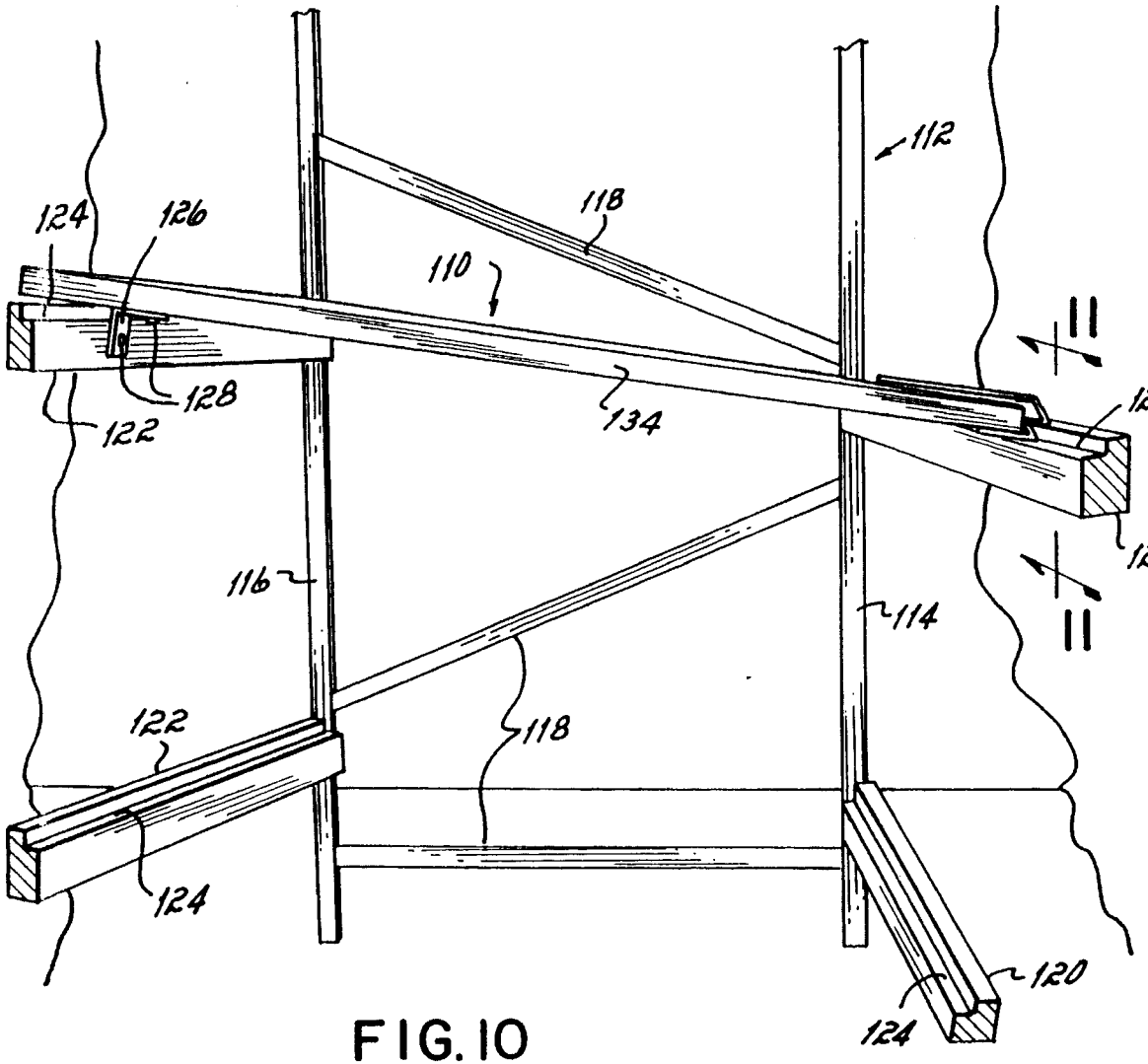
FIG. 10 is a cross-sectional view of a second embodiment of the shelf design of this invention in a warehouse-style rack system.

A shelf 110 design according to this invention is showed in another preferred embodiment in a warehouse-style rack system 112 in FIGS. 10 and 11. The warehouse-style rack 112 includes a front post 114 spaced from a back post 116-extending between aligned front and back posts are additional structural support frame members 118 as is well known in the art of warehouse-style display racks. Extending between adjacent front posts 114 (not shown) are front beams 120 and extending between adjacent back posts 116 (not shown) are back beams 122. Supported at the front edge 48 by the front beam 120 and at the back edge 36 by the back beam 122 is the gravity feed shelf 110 according to this invention. The front beam 120 supporting the shelf 110 is positioned vertically lower than the corresponding back beam 122 in order to provide for the gravity feed inclination of the shelf 110 as shown in FIG. 10. Typically, the front and back beams are box-shaped, metallic channel members which may include an indented lip 124 on an interior upper edge of the beam.

The shelf design 110 for use in the warehouse-style rack 112 according to this invention is identical to the shelf design 34 which was described with reference to the first embodiment of the invention with the following changes. A generally L-shaped bracket 126 is provided to secure the shelf 110 to the back beam 122 as shown in FIG. 10. Mechanical fasteners 128 such as screws or bolts are provided to secure each leg of the L-shaped bracket 126 to the back beam 122 or the underside surface of the shelf 110, preferably to the lower leg 140 of the side frame member 134. A front frame member 130 of the second embodiment of the shelf 110 is a different configuration than that of the first embodiment. The front frame member 130 in the second embodiment for use in the warehouse-style rack 112 has a generally zigzag cross-sectional configuration in which a lower leg 129 of the front frame member 130 underlies and supports the side frame members 134 of the shelf. Preferably, the lower leg 129 of the front frame member 130 is secured as by a bolt, screw or other fastener 131 to the lower leg 140 of the side frame member 134. The front frame member 130 is supported upon the front beam 120 so that the lower leg 129 rests upon the upper surface of the beam indentation 124 and a middle leg 133 of the front frame member 130 rests upon the upper surface of the front beam 120 as shown in FIG. 11. The inter-engaging configuration of the front frame member 130 with respect to the front beam 120 provides a secure and stable support for the shelf 110 of this invention.

An upper leg 135 of the front frame member 130 projects to overhang the front portion of the shelf 110. Holes 152 are provided in the upper leg 135 for the insertion of the bumper wire 50 therein. The upper leg 135 is also inserted into the notch 180 provided on the front edge of the dividers 170 to releasably secure the dividers 170 to the slip surface layer 162 and thereby provide adjustable channels for the gravity feed of merchandise supported upon the shelf 110.

As a result of the second embodiment, the shelf design according to this invention can be easily adapted to for use as a warehouse-style rack or supported in a cantilever configuration as shown in the first embodiment described herein.

From the above disclosure of the general principles of the present invention and the preceding description of preferred embodiments those skilled in the art will readily comprehend the various modifications to which the present invention is susceptible. Therefore, I desire to be limited only by the scope of the following claims and equivalents thereof.

I claim:

1. A gravity feed shelf for a display rack providing access to merchandise supported thereon, said shelf comprising:

a rectangular frame having a pair of spaced side members connecting a front member spaced from a back member, said side, front and back members defining an opening therebetween;

a plurality of channels supported on said frame, said channels spanning said opening and cooperating to form a shelf surface;

a ledge on each end of each said channel, said ledge being inserted into one of said frame members; and a slip surface layer positioned atop said shelf surface for gravity feed advance of the merchandise thereon.

2. The shelf of claim 1 further comprising:

a divider positioned atop said slip surface layer, said divider projecting upwardly from said slip surface layer and extending between said front frame member and said rear frame member to guide the gravity feed advance of the merchandise toward said front frame member.

3. The shelf of claim 2 wherein said divider is selectively attachable and detachable from said slip surface upper layer at a plurality of positions on the shelf.

4. The shelf of claim 1 further comprising:

a plurality of upwardly projecting spaced ribs on said slip surface layer, said ribs being generally parallel and extending between said front frame member and said rear frame member.

5. The shelf of claim 2 wherein said divider has a generally inverted Y-shaped base, each leg of said inverted Y-shaped base having a lip projecting therefrom, each said leg of said base being inserted between a pair of adjacent spaced ribs projecting upwardly from said slip surface layer, each said lip engaging one of said adjacent ribs.

6. A gravity feed shelf for a display rack providing access to merchandise supported thereon, said shelf comprising:

a rectangular frame having a pair of spaced side members connecting a front member spaced from a back member, said side, front and back members defining an opening therebetween;

a plurality of channels supported on said frame, said channels spanning said opening and cooperating to form a shelf surface;

a slip surface layer positioned atop said shelf surface for gravity feed advance of the merchandise thereon;

a divider positioned atop said slip surface layer, said divider projecting upwardly from said slip surface layer and extending between said front frame member and said rear frame member to guide the gravity feed advance of the merchandise toward said front frame member;

a notch at a front end and a notch at a rear end of said divider; and a tab projecting from each said front frame member and said rear frame member, said front frame member tab and said rear frame member tab being inserted into said front end notch and said rear end notch, respectively, to attach said divider to the shelf.

7. The shelf of claim 6 wherein said divider has an upwardly directed bowed configuration such that said front and rear ends each bow upwardly relative to a middle portion of said divider, said upwardly bowed configuration enabling said front and rear end notches to engage said front and rear frame member tabs, respectively, and secure said divider to the shelf.

8. The shelf of claim 7 further comprising:

a detent within each said notch, said detent engaging said tab when said divider is attached to said shelf.

9. A gravity feed shelf for display rack providing access to merchandise supported thereon, said shelf comprising:

a rectangular frame having a pair of spaced side members connecting a front member spaced from a back member, said side, front and back members defining an opening therebetween;

a plurality of channels supported on said frame, said channels spanning said opening and cooperating to form a shelf surface; and a slip surface layer positioned atop said shelf surface for gravity feed advance of the merchandise thereon;

wherein each said channel has a generally inverted box shaped configuration with a pair of spaced sidewalls projecting downwardly from a top wall, said top walls of said channels cooperating to form said shelf surface.

10. The shelf of claim 9 wherein each said channel is coupled to an adjacent said channel.

11. The shelf of claim 10 further comprising:

an upwardly projecting hook extending from a bottom edge of one of said sidewalls of each said channel, one of said sidewalls of said adjacent channel being nested within said hook to thereby couple said adjacent channels.

12. The shelf of claim 1 wherein said channels extend laterally across the shelf.

13. The shelf of claim 1 wherein said frame is supported in a cantilever configuration on a gondola style display rack.

14. The shelf of claim 1 wherein said frame is supported by a front beam and a rear beam of a warehouse style display rack.

15. The shelf of claim 1 further comprising:

a stop at a front edge of the shelf to retain merchandise supported thereon.

16. The shelf of claim 15 wherein said stop comprises a generally inverted U-shaped bumper wire having a pair of downwardly extending legs, each said leg being inserted into a hole in said front frame member.

17. A display rack comprising:

a plurality of generally upright posts having a top end and, a bottom end;

a base attached to said bottom end of each said post for bracing said post in a generally vertical orientation, said post and said base forming a frame section, each said frame section being joined to an adjacent said frame section by a connector;

at least one shelf being supported in a generally cantilever manner between an adjacent pair of said posts;

said shelf further comprising:

a rectangular frame having a pair of spaced side members connecting a front member spaced from a back member, said side, front and back members defining an opening therebetween;

a plurality of channels supported on said frame, said channels spanning said opening and cooperating to form a shelf surface;

a ledge on each end of each said channel, said ledge being inserted into one of said frame members; and a slip surface layer positioned atop said shelf surface for gravity feed advance of the merchandise thereon.

18. The display rack of claim 17 further comprising:

a divider positioned atop said slip surface layer, said divider projecting upwardly from said slip surface layer and extending between said front frame member and said rear frame member to guide the gravity feed advance of the merchandise toward said front frame member.

19. The display rack of claim 18 wherein said divider is selectively attachable and detachable from said slip surface upper layer at a plurality of positions on the shelf.

20. The display rack of claim 17 further comprising:

a plurality of upwardly projecting spaced ribs on said slip surface layer, said ribs being generally parallel and extending between said front frame member and said rear frame member.

21. The display rack of claim 18 wherein said divider has a generally inverted Y-shaped base, each leg of said inverted Y-shaped base having a lip projecting therefrom, each said leg of said base being inserted between a pair of adjacent spaced ribs projecting upwardly from said slip surface layer, each said lip engaging one of said adjacent ribs.

22. A display rack comprising:

a plurality of generally upright posts having a top end and, a bottom end;

a base attached to said bottom end of each said post for bracing said post in a generally vertical orientation, said post and said base forming a frame section, each said frame section being joined to an adjacent said frame section by a connector;

at least one shelf being supported in a generally cantilever manner between an adjacent pair of said posts;

said shelf further comprising:

a rectangular frame having a pair of spaced side members connecting a front member spaced from a back member, said side, front and back members defining an opening therebetween;

a plurality of channels supported on said frame, said channels spanning said opening and cooperating to form shelf surface; and a slip surface layer positioned to said shelf surface for gravity feed advance of the merchandise thereon;

wherein each said channel has a generally inverted box shaped configuration with a pair of spaced sidewalls projecting downwardly from a top wall, said top walls of said channels cooperating to form said shelf surface.

23. A display rack comprising:

a plurality of generally upright posts having a top end and, a bottom end;

a base attached to said bottom end of each said post for bracing said post in a generally vertical orientation, said post and said base forming a frame section, each said frame section being joined to an adjacent said frame section by a connector;

at least one shelf being supported in a generally cantilever manner between an adjacent pair of said posts;

said shelf further comprising;

a rectangular frame having a pair of spaced side members connecting a front member spaced from a back member, said side, front and back members defining an opening therebetween;

a plurality of channels supported on said frame, said channels spanning said opening and cooperating to form a shelf surface; and a slip surface layer positioned atop said shelf surface for gravity feed advance of the merchandise thereon;

wherein each said channel is coupled to an adjacent said channel.

24. The display rack of claim 23 further comprising:

an upwardly projecting hook extending from a bottom edge of one of said sidewalls of each said channel, one of said sidewalls of said adjacent channel being nested within said hook to thereby couple said adjacent channels.

25. The display rack of claim 17 wherein said channels extend laterally across the shelf.

26. A display rack comprising:

a pair of front posts;

a pair of back posts;

a front beam connecting said front posts;

a back beam connecting said back posts;

at least one shelf being supported in a gravity feed configuration by said front and back beams such that a front edge of said shelf is lower than a back edge of said shelf;

said shelf further comprising:

a rectangular frame having a pair of spaced side members connecting a front member spaced from a back member, said side, front and back members defining an opening therebetween;

a plurality of channels supported on said frame, said channels spanning said opening and cooperating to form a shelf surface; and a slip surface layer positioned atop said shelf surface for gravity feed advance of the merchandise thereon.

27. The display rack of claim 26 further comprising:

a divider positioned atop said slip surface layer, said divider projecting upwardly from said slip surface layer and extending between said front frame member and said rear frame member to guide the gravity feed advance of the merchandise toward said front frame member.

28. The display rack of claim 27 wherein said divider is selectively attachable and detachable from said slip surface upper layer at a plurality of positions on the shelf.

29. The display rack of claim 26 further comprising:

a plurality of upwardly projecting spaced ribs on said slip surface layer, said ribs being generally parallel and extending between said front frame member and said rear frame member.

30. The display rack of claim 27 wherein said divider has a generally inverted Y-shaped base, each leg of said inverted Y-shaped base having a lip projecting therefrom, each said leg of said base being inserted between a pair of adjacent spaced ribs projecting upwardly from said slip surface layer, each said lip engaging one of said adjacent ribs.

31. The display rack of claim 26 wherein each said channel has a generally inverted box shaped configuration with a pair of spaced sidewalls projecting downwardly from a top wall, said top walls of said channels cooperating to form said shelf surface.

32. The display rack of claim 26 wherein each said channel is coupled to an adjacent said channel.

33. The display rack of claim 23 further comprising:

an upwardly projecting hook extending from a bottom edge of one of said sidewalls of each said channel, one of said sidewalls of said adjacent channel being nested within said hook to thereby couple said adjacent channels.

34. The display rack of claim 26 further comprising:

a ledge on each end of each said channel, said ledge being inserted into one of said frame members.

35. The display rack of claim 26 wherein said channels extend laterally across the shelf.

36. A gravity feed shelf for a display rack providing access to merchandise supported thereon, said shelf comprising:

a frame having a pair of spaced side members connecting a front member spaced from a back member, said side, front and back members defining an opening;

a plurality of channels supported on said frame, said channels spanning said opening and cooperating to form a shelf surface, each said channel having a generally inverted box shaped configuration with a pair of spaced sidewalls projecting downwardly from a top wall, said top walls of said channels cooperating to form said shelf surface, an upwardly projecting hook extending from a bottom edge of one of said sidewalls of each said channel, one of said sidewalls of said adjacent channel being nested within said hook to thereby couple said adjacent channels;

a slip surface layer positioned atop said shelf surface for gravity feed advance of the merchandise thereon; and a plurality of upwardly projecting spaced ribs on said slip surface layer, said ribs being generally parallel and extending between said front frame member and said rear frame member.

37. The shelf of claim 36 further comprising:

a divider positioned atop said slip surface layer, said divider projecting upwardly from said slip surface layer and extending between said front frame member and said rear frame member to guide the gravity feed advance of the merchandise toward said front frame member.

38. The shelf of claim 37 wherein said divider is selectively attachable and detachable from said slip surface layer at a plurality of positions on the shelf.

39. The shelf of claim 37 wherein said divider has a generally inverted Y-shaped base, each leg of said inverted Y-shaped base having a lip projecting therefrom, each said leg of said base being inserted between a pair of adjacent spaced ribs projecting upwardly from said slip surface layer, each said lip engaging one of said adjacent ribs.

40. The shelf of claim 36 further comprising:

a ledge on each end of each said channel, said ledge being inserted into one of said frame members.

41. The shelf of claim 36 wherein said channels extend laterally across the shelf.

* * * * *

UNITED STATES PATENT AND TRADEMARK OFFICE

CERTIFICATE OF CORRECTION

PATENT NO. : 5,577,623

DATED : November 26, 1996

INVENTOR(S) : Rafael T. Bustos

It is certified that error appears in the above-indentified patent and that said Letters Patent is hereby corrected as shown below:

Column 1, Line 5, "Ser. No. 16,783" should read --Ser. No. 08/016,783--.

Column 10, Line 50, to said shelf surface" should read --atop said shelf surface--.

Signed and Sealed this

Twelfth Day of August, 1997

Bruce Lehman

*Attest:*

BRUCE LEHMAN

*Attesting Officer*

*Commissioner of Patents and Trademarks*